United States Patent [19]

Bratthäll et al.

[11] 3,973,624

[45] Aug. 10, 1976

[54] CONDENSER

[75] Inventors: Lars Bratthäll; Erik Henriksson; Lars Olof Ingesson, all of Linkoping, Sweden

[73] Assignee: Stal-Laval Apparat AB, Linkoping, Sweden

[22] Filed: Mar. 25, 1974

[21] Appl. No.: 454,434

[30] Foreign Application Priority Data

Apr. 6, 1973 Sweden ..... 7304858

[52] U.S. Cl. ..... 165/114; 165/161

[51] Int. Cl.[2] ..... F28B 9/10

[58] Field of Search ..... 165/113, 114, 111, 161

[56] References Cited

UNITED STATES PATENTS

| | | | |
|---|---|---|---|
| 1,142,784 | 6/1915 | Ehrhart | 165/114 |
| 1,591,769 | 7/1926 | Morgan | 165/114 |
| 1,719,909 | 7/1929 | Spillman | 165/114 |
| 1,845,538 | 2/1932 | Lidiak | 165/114 |
| 1,935,822 | 11/1933 | Smith | 165/114 |
| 3,139,926 | 7/1964 | Tinker | 165/111 |

FOREIGN PATENTS OR APPLICATIONS

| | | | |
|---|---|---|---|
| 302,547 | 12/1928 | United Kingdom | 165/114 |

*Primary Examiner*—Albert W. Davis, Jr.
*Attorney, Agent, or Firm*—Eric Y. Munson

[57] ABSTRACT

Condenser for a gaseous media such as steam, comprising a plurality of longitudinal tubes, generally several thousands, through which a coolant passes. Steam is passed around these tubes, and the tubes are braced at selected locations in longitudinal direction by means of brace plates or the like, and the steam is passed from the periphery of the heat exchanger and toward the interior thereof during condensaton. The condenser comprises a casing or shell and one or more nests of tubes and means for circulating steam around the entire or greater part of the periphery, and within each tube nest, an air-cooler device is placed centrally or substantially centrally, which air-cooler extends along the entire length of the tube nest. The brace plates are provided with flow channels effective to distribute the gaseous media about the condenser in response to fluctuation in condensing capacity along the tube nests.

5 Claims, 3 Drawing Figures

CONDENSER

BACKGROUND OF THE INVENTION

The tube nest consists of straight or U-bent tubes through which water or other cooling liquid is passed thus condensing the steam flowing in from the periphery on the surfaces of the tubes. Water flows in one or more directions through the tubes. The water is at all times in liquid phase and takes up the vaporization heat of the condensed steam during its passage through the tubes with consequent continuous increase in, the temperature of the water. The steam is condensed on the outer surface of the tubes while the temperature remains substantially constant. This means that the condensing capacity, which is proportionate to the difference in temperature between the steam and the water, varies along the length of the tubes, with the greatest capacity at the water inlet end and continuously decreasing capacity towards the warmer outlet end.

The driving force for the supply of steam is the pressure differential between the outer periphery of the tube nest and the ventilated air-cooling section. Since this pressure differential is substantially constant for the entire tube nest, an excess of steam will be supplied to the warmer sections of the tube nest, and a corresponding deficient amount of steam will be supplied to the colder sections. This leads to a tendency for the steam to flow from the warmer section of the tube nest to the colder section.

However, since such tendency is completely or partly prevented in the conventional constructions of heat exchangers, due to the fact, that among others, that the tubes are braced at selected locations in longitudinal direction, usually by plates, there will be a shortage of steam in the colder parts and the steam will flow into these sections through the back entrance through the air cooler portion or through overflow openings. This leads to the creation of stagnation zones in the colder sections of the tube nest, and non-condensable gases, such as air, present in the steam will accumulate in these zones and thus prevent condensation.

The aforementioned bracing of the tubes is a necessary precaution in order to prevent vibrations in the tubes and to impart stability to the tube nest. This is normally accomplished by means of transverse brace plates which are provided with bores arranged in accordance with the tube pattern and which fit about the tubes which extend through the brace plates. Such brace plates are spaced from each other in a manner suitable for supporting the tubes, but the plates will then form walls preventing the desired longitudinal distribution of the steam, which may also be prevented by other construction details in the condenser.

SUMMARY OF THE INVENTION

The aforementioned and other related drawbacks are avoided by a condenser according to the invention. This is characterised by the provision of brace plates which are provided with notches to allow the steam to flow in a longitudinal direction and to distribute it in the condensing sections and in the air-cooler sections within the tube nest, corresponding to the axially varying condensing capacity of the tube nest, the notches in the brace plates serving only as flow channels and accommodating no tubes. The location of these notches within the tube nest is the reason for omitting tubes at these locations.

BRIEF DESCRIPTION OF THE DRAWING

The invention is exemplified in greater detail in the accompanying drawings in which.

DESCRIPTION OF AN EMBODIMENT OF THE INVENTION

Figure 1:
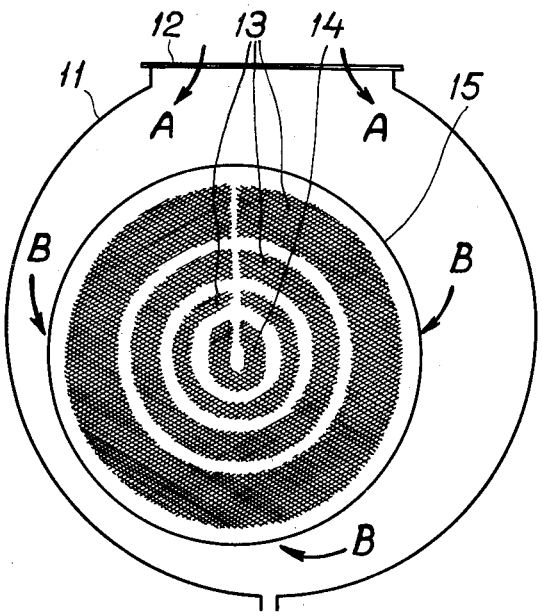
FIG. 1 is a cross-sectional view of a condenser according to the invention.

FIG. 1 illustrates a heat exchanger in which steam to be condensed enters section 12 in the direction of the arrows A. The steam is distributed within the shell 11 around a tube nest 13 (see the arrows B). The outer part of the tube nest is the condensing portion and the inner part the air-cooling portion 14. The reference numeral 15 denotes the tube supports.

Figure 2:
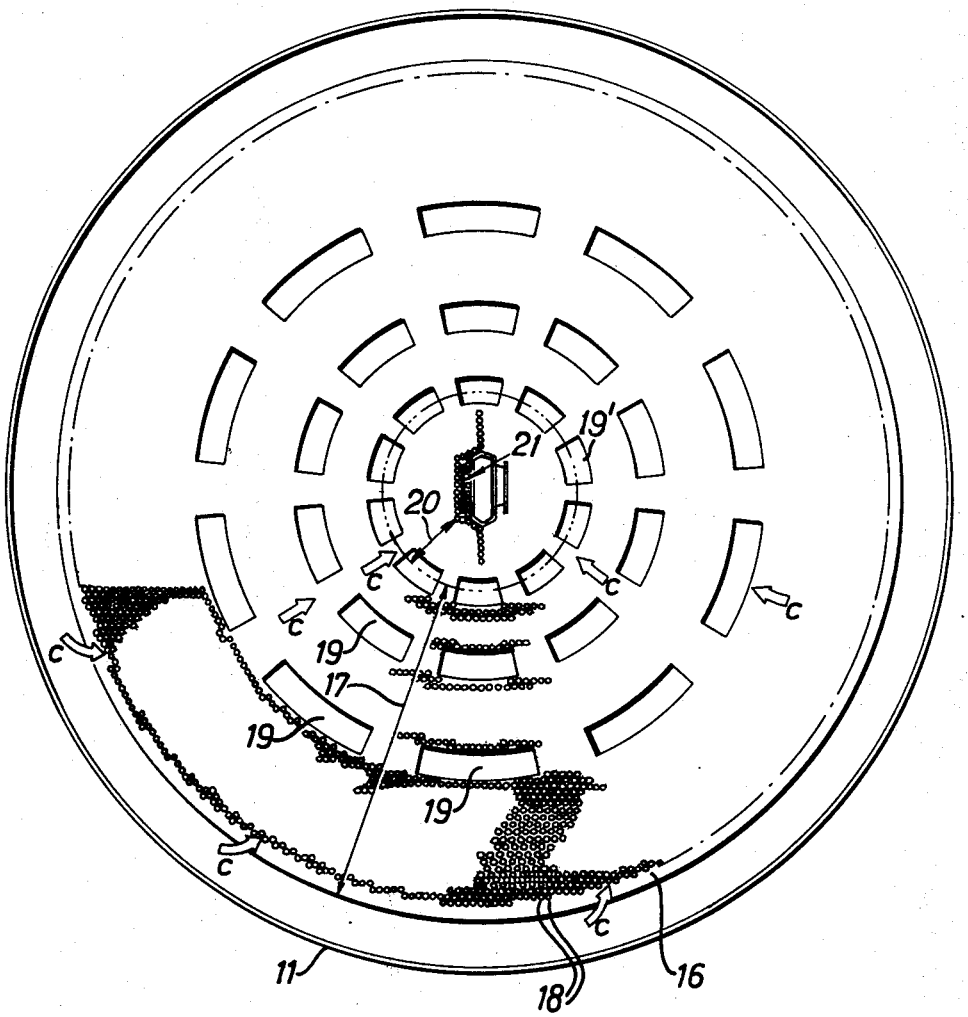
FIG. 2 is a cross-section through a condenser tube nest and FIG. 3 a cross-sectional view of the air cooler.

FIG. 2 shows also the shell 11 inside which is a cross-section of a brace plate 16. Two, three or more such plates are arranged along the length of the tube nest, and between these, steam is allowed to pass through the condensing portion towards the air cooler. The condensing portion 17 is composed of the outer tubes between which tubes steam flows in, such as water steam, while being successively condensed on the tubes 18 through which water flows. (See the arrows C in FIG. 2, which denote the direction of flow of the steam.)

In selected cross-sectional areas in the tube nest, which are determined by the condensing capacity of the condenser, are placed brace plates with notches or channels in order to allow passage of steam between the warmer and colder sections of the tube nest with a view to preventing the creation of stagnation zones in the condensing and air cooler portions. The notches have segment-shaped or rectangular cross-sections, more or less rounded in the corners. In the shown embodiment the notches are arranged in circular patterns concentric with the air cooler portion, but this is only one of many possible examples. The notches 19 are devoid of tubes.

Inside the condensing portion 17 is an air cooler portion 14, consisting of a precooling portion 20 and an air cooling portion 21 (re-cooler). The purpose of the air cooler is to evacuate non-condensable gases, such as air and the steam which remains after condensation on the tubes 18.

As mentioned, the direction of the water flow is suitably unidirectional (single flow).

The tubes are suitably made of brass or a copper-nickel alloy or a titanium alloy, and the tube nest does not necessarily have to be concentric with the air cooler, but can also be eccentric. The cross-section of the tube nest 13 may be circular, oval, square or some other shape.

By arranging the tubes and the notches 19 in this manner, accumulation of gas in the tube nest 13 is also avoided.

The tubes 18 are suitably straight and parallel- and series-connected, or an arrangement with a combination of these connections may be used.

Figure 3:
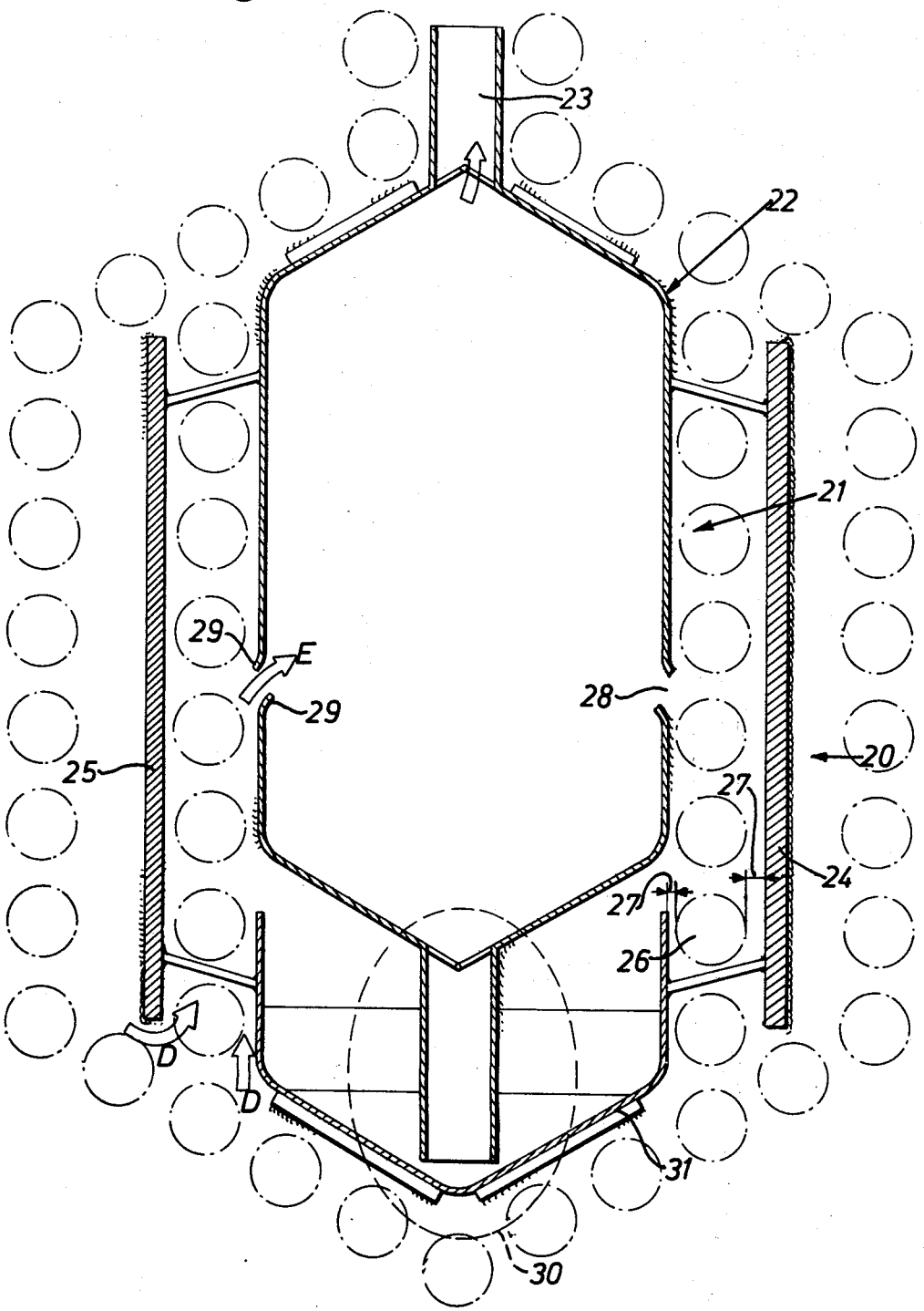

FIG. 3 shows the ventilated air cooler which is necessary for the operation. It is centrally placed (see 14 in FIG. 1) and consists of a fairly small, circular tube nest portion 20 with a centrally located longitudinal drum 22 for evacuation of air. The circular tube nest portion within the air-cooling portion is called precooler 20, whereas the rows of tubes 21 between the drum 22 and the metal sheet 24 is called re-cooler. The drum 22 communicates with an evacuation channel 23 extending radially to the periphery of the tube nest, said channel being positioned in one of the tube nest ends or is some other place. From this evacuation channel 23 non-condensable gases, such as air, are discharged through a conduit connected to the condenser shell, said conduit being suitably connected to an air pump (not shown). Said evacuation can also be accomplished by means of overpressure in a manner not shown.

The air cooler portion 20, 21 consists of a precooler 20, which is open around the periphery, and a central re-cooler 21 in the manner shown. The re-cooler 21 comprises two vertical sides 24 and 25 which are spaced a certain distance from the drum 22. Between the vertical walls 24, 25 and the central drum there are tubes 26 having gaps 27 between the tubes and the walls. The steam flows in along the entire length of the tube nest in the gaps (see the arrows D in FIG. 3) between the walls 24, 25 of the re-cooler and the tube located in the opening. The width 27 of the gap is adjusted so that a predetermined degree of throttling is obtained, which, together with apertures 28 provided in the vertical walls of the drum along the entire length, produces a controlled distribution of the steam into the air cooler portion (see arrow E), and a high rate of flow and controlled heat transmission.

The apertures 28 in the drum 22 are shaped so that the condensate running down the wall is not sucked in through the apertures. This can possibly be arranged by means of water discharge 29. Any water in the drum 22 is drained in both ends of the discharge by means of water locks 30. These water locks are situated in a groove extending longitudinally below the drum in, which groove the descending condensate collects and provides the water lock with water. The groove is also a part of the channel wall 31 of the re-cooler.

By locating the evacuation channel 23 from the drum 22 in a confined part of one end of the tube nest, the upper end in the example shown, an open construction is obtained with regard to steam distribution, with no sections being screened off by any built-in devices.

The tubes in the air cooler portion, see e.g. 26, are flushed with condensate from the tubes lying above, so the gas-enriched environment prevailing in this section will not have any corrosive effect on the tubes, which would otherwise be the case if the tubes 18, 26, etc., were screened off from the flushing of condensate in a closed channel.

The shape of the air cooler portion and its drum is of course arbitrary and may be varied in many ways.

The invention as a whole can be varied in many ways within the scope of the following claims.

We claim:

1. A condenser for a gaseous media such as steam and the like, comprising:

a. a shell defining a condensing chamber and having an inlet for the gaseous media;

b. a tubular structure comprising a maze of tubes arranged in nest-like formation within said shell for passing a coolant media from an inlet end to an outlet end in said condensing chamber;

c. a plurality of passages for passing the gaseous media in heat exchange relationship with said coolant media as the latter flows from said inlet end to said outlet end and defining a cold end and a warm end between which ends the condensing capacity fluctuates in proportion to fluctuations in temperature as the gaseous media is condensed on the tubes;

d. said tubular structure comprising a peripheral condenser portion and an air cooler for evacuating non-condensable gases surrounded by and located substantially centrally within said peripheral portion and being spaced therefrom by said gas media passages;

e. said passages being effective to pass the gaseous media from said peripheral condenser portion towards said air cooler;

f. brace means supporting said tubular structures within said shell;

g. said brace means having flow channels for the gaseous media and being free of obstruction by the tube and being arranged at selected locations effective to distribute the gaseous media about said condenser portion and said air cooler in response to fluctuations in condensing capacity as the coolant media is passed from the said cold end to said warm end;

h. said air cooler comprising a tube nest precooling portion with a centrally located longitudinal drum for evacuation of non-condensable gases spaced from and surrounding a recooling portion;

i. said recooling portion comprising wall means spaced from the drum and surrounding tubes, the wall means and tubes having gaps therebetween and defining an inlet portion for the passage of the gaseous media to the evacuation drum; and j. said cooling portions forming an open construction and being arranged so that adjacent tubes are flushed by condensate from remote tubes.

2. A condenser according to claim 1, wherein the inlet portion passages are formed as throttling means and provided with water discharge.

3. Condenser according to claim 1, wherein the flow channels in the stay plates are formed as segments.

4. Condenser according to claim 1, wherein the flow channels in the stay plates are formed as rectangles.

5. A condenser according to claim 1, wherein the evacuation drum is provided with one or more gas evacuation conduits and with one or more liquid locks.

* * * * *